US008462051B2

(12) United States Patent
Tanaka et al.

(10) Patent No.: US 8,462,051 B2
(45) Date of Patent: Jun. 11, 2013

(54) CHIP ANTENNA AND ANTENNA APPARATUS

(75) Inventors: Hiroya Tanaka, Kyoto-fu (JP); Ryo Komura, Kyoto-fu (JP); Kazuhisa Yamaki, Kyoto-fu (JP); Yuichi Kushihi, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 216 days.

(21) Appl. No.: 13/193,291

(22) Filed: Jul. 28, 2011

(65) Prior Publication Data

US 2011/0279349 A1 Nov. 17, 2011

Related U.S. Application Data

(63) Continuation of application No. PCT/JP2009/063658, filed on Jul. 31, 2009.

(30) Foreign Application Priority Data

Jan. 29, 2009 (JP) ..... 2009-017854

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702, 906
See application file for complete search history.

(56) References Cited

U.S. PATENT DOCUMENTS

| | | | | |
|---|---|---|---|---|
| 6,781,545 | B2 | 8/2004 | Sung | |
| 6,803,881 | B2 * | 10/2004 | Ishihara et al. | 343/700 MS |
| 6,950,072 | B2 * | 9/2005 | Miyata et al. | 343/702 |
| 7,136,020 | B2 * | 11/2006 | Yamaki | 343/702 |
| 2005/0099347 | A1 | 5/2005 | Yamaki | |
| 2010/0220030 | A1 * | 9/2010 | Shimoda et al. | 343/860 |
| 2011/0095947 | A1 * | 4/2011 | Chou | 343/700 MS |
| 2011/0298683 | A1 * | 12/2011 | Tanaka et al. | 343/841 |

FOREIGN PATENT DOCUMENTS

| | | | |
|---|---|---|---|
| JP | 2002-033620 | A | 1/2002 |
| JP | 2004-007345 | A | 1/2004 |
| JP | 2005-150937 | A | 6/2005 |
| WO | 2005/078860 | A1 | 8/2005 |
| WO | 2006/120762 | A1 | 11/2006 |

OTHER PUBLICATIONS

International Search Report; PCT/JP2009/063658; Nov. 2, 2009.

(Continued)

*Primary Examiner* — Tan Ho

(74) *Attorney, Agent, or Firm* — Studebaker & Brackett PC

(57) ABSTRACT

A chip antenna and an antenna apparatus, which allow the resonance frequency of the antenna to be set with a high degree of freedom, include a feeding electrode formed on the bottom surface, fourth side surface, and top surface of a dielectric substrate, a non-feeding electrode formed on the bottom surface, third side surface, and top surface of the dielectric substrate, wherein the leading ends of the feeding electrode and the non-feeding electrode are facing each other with a predetermined distance therebetween on the top surface of the dielectric substrate. The chip antenna and antenna apparatus further include a frequency adjusting electrode formed on the first side surface of the dielectric substrate, and ground electrodes connected to ground electrodes of a circuit substrate on which the chip antenna is mounted, wherein the ground electrodes are electrically connected to the frequency adjusting electrode and are formed on the bottom surface of the dielectric substrate.

18 Claims, 7 Drawing Sheets

OTHER PUBLICATIONS

Written Opinion of the International Searching Authority; PCT/JP2009/063658; Nov. 2, 2009.

A. Erentok et al.; "Metamaterial-Inspired Efficient Electrically Small Antennas" IEEE Transactions on Antennas and Propagation, vol. 56, No. 3, Mar. 2008.

First Office Action issued by the State Intellectual Property Office of People's Republic of China on Apr. 2, 2013, which corresponds to Chinese Patent Application No. 200980155630.3 and is related to U.S. Appl. No. 13/193,291 with English translation.

* cited by examiner ( A )
PRIOR ART ( B )
PRIOR ART

CHIP ANTENNA AND ANTENNA APPARATUS

CROSS REFERENCE TO RELATED APPLICATIONS

The present application claims priority to Japanese Patent Application No. 2009-017854 filed Jan. 29, 2009, and International Patent Application No. PCT/JP2009/063658 filed Jul. 31, 2009, the entire contents of each of these applications are being incorporated herein by reference in their entirety.

FIELD OF THE INVENTION

The present invention relates to chip antennas and antenna apparatuses including the chip antennas, and in particular to a chip antenna and an antenna apparatus in which a feeding electrode and a non-feeding electrode are arranged on a dielectric substrate so as to face each other with a predetermined distance therebetween.

BACKGROUND

Japanese Unexamined Patent Application Publication No. 2004-7345 discloses a chip antenna in which a feeding electrode and a non-feeding electrode are arranged on a dielectric substrate so as to face each other with a predetermined distance therebetween. FIG. 1(A) is a six-surface diagram of the chip antenna disclosed in Japanese Unexamined Patent Application Publication No. 2004-7345, and FIG. 1(B) is an equivalent circuit thereof.

Referring to FIG. 1(A), a feeding electrode 34 is formed on the bottom surface, fourth side surface, and top surface of a dielectric substrate 31 shaped like a rectangular parallelepiped. Similarly, a non-feeding electrode 36 is formed on the bottom surface, the third side surface, and the top surface. The feeding electrode 34 and the non-feeding electrode 36 are formed so as to face each other with a predetermined distance therebetween on the top surface of the dielectric substrate 31.

Referring to FIG. 1(B), the feeding electrode 34 and the non-feeding electrode 36 are coupled to each other as a result of the open ends thereof facing each other with a predetermined distance therebetween. Thereby, wide-band characteristics are obtained.

However, in the existing chip antenna disclosed in FIG. 1(A), where a chip antenna 30 is mounted in a non-ground area of a circuit substrate, since the resonant frequency of the antenna strongly depends on a positional relationship between the antenna and the ground electrode on the circuit substrate, the resonant frequency of the antenna needs to be adjusted by, for example, changing the area of the non-ground area, in accordance with the surrounding environment, such as other mounted components and the casing close to the mounting area of the chip antenna on the circuit substrate. Hence, there has been a problem in that the area of the non-ground area cannot be fixed.

SUMMARY

Accordingly, in an embodiment of the present disclosure provides a chip antenna and an antenna apparatus which allow the resonant frequency of the antenna to be set with a high degree of freedom.

A chip antenna according to a more specific embodiment is configured to include: a rectangular parallelepiped shaped dielectric substrate including a bottom surface (mounting surface), a top surface, first and second side surfaces facing each other, and third and fourth side surfaces (end surfaces) facing each other; and electrodes formed on outer surfaces of the dielectric substrate.

A feeding electrode is formed on the fourth side surface and the top surface, and a non-feeding electrode is formed on the third side surface and the top surface, the non-feeding electrode and the feeding electrode facing each other with a predetermined distance therebetween.

A frequency adjusting electrode is formed on the first side surface of the dielectric substrate.

A ground electrode that is connected to a ground electrode of a circuit substrate on which the chip antenna is mounted, and that is electrically connected to the frequency adjusting electrode is formed on the bottom surface of the dielectric substrate.

The ground electrode may be configured to extend from the bottom surface to the second side surface of the dielectric substrate.

The frequency adjusting electrode may be formed not only on the first side surface but also on the second side surface of the dielectric substrate.

The frequency adjusting electrode may extend to the third or fourth side surface or the third and fourth side surfaces of the dielectric substrate.

A chip antenna according to another more specific embodiment is configured to include: a rectangular parallelepiped shaped dielectric substrate including a bottom surface (mounting surface), a top surface, first and second side surfaces facing each other, and third and fourth side surfaces (end surfaces) facing each other; and electrodes formed on outer surfaces of the dielectric substrate.

A feeding electrode is formed on the fourth side surface and the top surface, and a non-feeding electrode is formed on the third side surface and the top surface, the non-feeding electrode and the feeding electrode facing each other with a predetermined distance therebetween.

A frequency adjusting electrode is formed on the bottom surface of the dielectric substrate.

A ground electrode that is connected to a ground electrode of a circuit substrate on which the chip antenna is mounted and that is electrically connected to the frequency adjusting electrode is formed on the first or second side surface or the first and second side surfaces of the dielectric substrate.

A first non-feeding electrode may be formed on the fourth side surface and the top surface, and a second non-feeding electrode may be formed on the third side surface and the top surface, the first and second non-feeding electrodes facing each other with a predetermined distance therebetween.

A frequency adjusting electrode may be formed on the first side surface of the dielectric substrate.

A ground electrode that is connected to a ground electrode of a circuit substrate on which the chip antenna is mounted and that is electrically connected to the frequency adjusting electrode may be formed on the bottom surface of the dielectric substrate.

The dielectric substrate may be provided with a feeding electrode so that a capacitance is generated between the feeding electrode and the first or second non-feeding electrode, and the feeding electrode is electrically connected to a feeding line on a circuit substrate on which the chip antenna is mounted.

An antenna apparatus according to an embodiment of the disclosure is formed of the chip antenna according to any one of the configurations described above and a circuit substrate on which the chip antenna is mounted, and the circuit substrate is provided with a frequency adjusting device that is connected between the ground electrode of the circuit substrate and one, more than one, or all of the frequency adjusting electrode, the feeding electrode, the non-feeding electrode, and the ground electrode.

An antenna apparatus according to another embodiment is formed of the chip antenna according to any one of the configurations described above and a circuit substrate on which the chip antenna is mounted, and the circuit substrate is provided with an impedance device that is connected between a feeding line on the circuit substrate electrically connected to the feeding electrode and the ground electrode on the circuit substrate.

According to the embodiments of the chip antenna and antenna apparatus, a frequency adjusting electrode is connected to a ground electrode, and an inter-electrode distance between the frequency adjusting electrode and a feeding electrode, and an inter-electrode distance between the frequency adjusting electrode and a non-feeding electrode can be set for a stand-alone chip antenna.

Capacitances are respectively generated between the feeding electrode and the frequency adjusting electrode, and between the non-feeding electrode and the frequency adjusting electrode. A current flowing through the feeding electrode and the non-feeding electrode flows into the frequency adjusting electrode through the ground, and the frequency adjusting electrode becomes a current path. Hence, the resonance frequency of the antenna can be set by using the capacitances. Consequently, the resonant frequency of the antenna can be set without changing the area of a non-ground area to be formed on a circuit substrate on which the chip antenna is mounted. As a result, since the frequency can be lowered, a reduction in the sizes of a chip antenna and an antenna apparatus can be realized.

Other features, elements, characteristics and advantages of the present disclosure will become more apparent from the following detailed description of preferred embodiments of the present disclosure with reference to the attached drawings.

DETAILED DESCRIPTION

Figure 1:
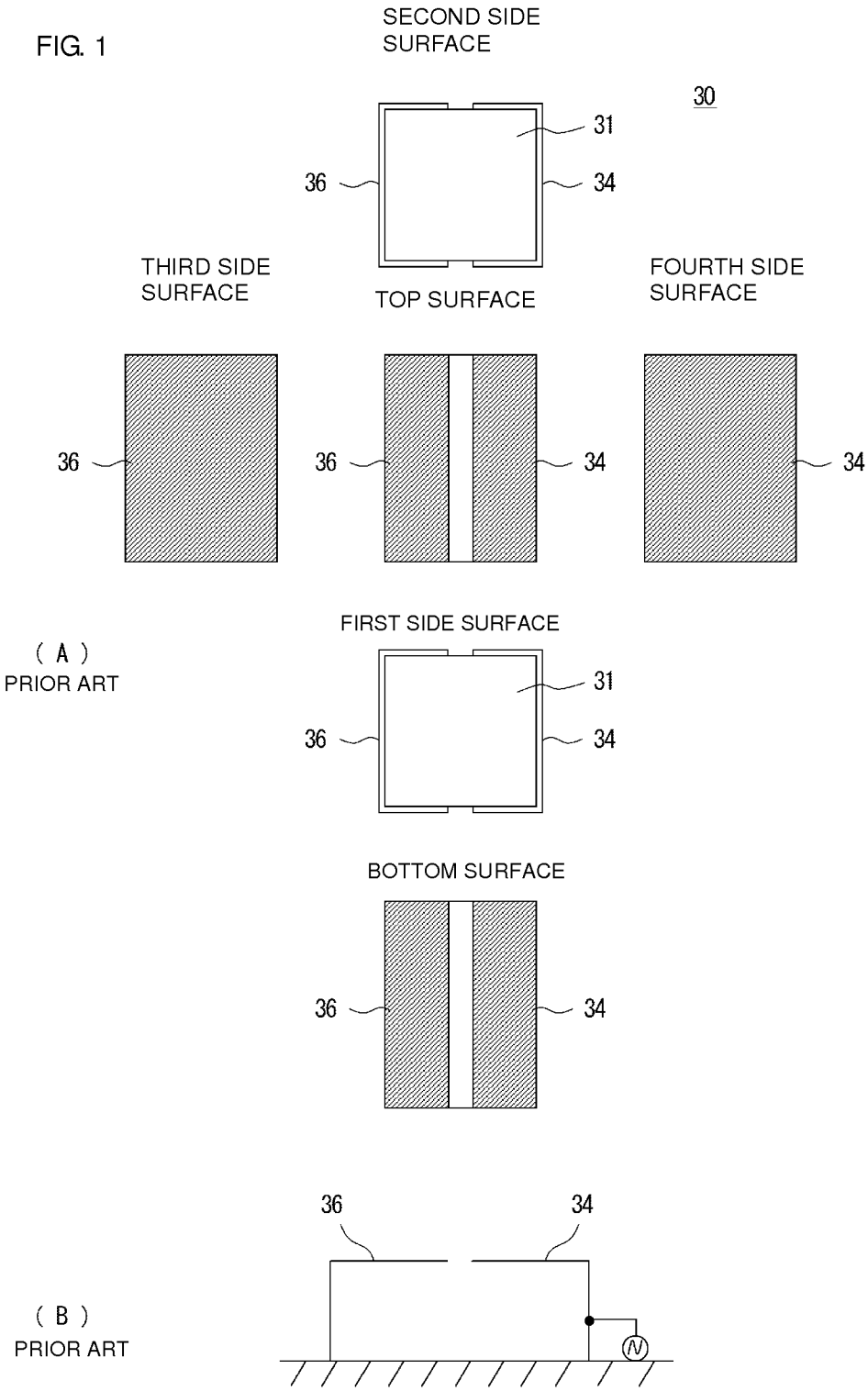
FIG. 1(A) illustrates a six-surface diagram of a chip antenna disclosed in Japanese Unexamined Patent Application Publication No. 2004-7345.
FIG. 1(B) illustrates and an equivalent circuit of a chip antenna disclosed in Japanese Unexamined Patent Application Publication No. 2004-7345.

A first exemplary embodiment of the present disclosure is as follows:

FIG. 2(A) is a six-surface diagram of a chip antenna 101 according to a first embodiment, FIG. 2(B) is a perspective view of the main portions of an antenna apparatus 201 including the chip antenna 101, and FIG. 2(C) is an equivalent circuit of the antenna apparatus 201.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the feeding electrode 11 and the non-feeding electrode 12 face each other with a predetermined distance therebetween on the top surface of the dielectric substrate 10. The first side surface of the dielectric substrate 10 has a frequency adjusting electrode 13 formed thereon. The bottom surface of the dielectric substrate 10 has ground electrodes 14 and 15 formed thereon that are electrically connected to the ground electrodes of a circuit substrate on which the chip antenna is mounted and that are electrically connected to the frequency adjusting electrode 13.

Referring to FIG. 2(B), a ground electrode 20 is formed and a non-ground area NGA is provided on the top surface of a circuit substrate 50. The chip antenna 101 is mounted within the non-ground area NGA, as illustrated in the figure. The non-ground area NGA has a feeding line 21, a non-feeding line 22, ground lines 24 and 25, and a feeding branch line 26 provided therein. In a state in which the chip antenna 101 is mounted, a base portion of the feeding electrode 11 (portion of the feeding electrode 11 formed on the bottom surface of the dielectric substrate 10) is electrically connected to the feeding line 21. A base portion of the non-feeding electrode (portion of the non-feeding electrode 12 formed on the bottom surface of the dielectric substrate 10) is electrically connected to the non-feeding line 22. Further, the ground electrodes 14 and 15 on the bottom surface are respectively electrically connected to the ground lines 24 and 25. A feeding circuit, which is not illustrated in FIG. 2(B), is connected between the feeding branch line 26 and the ground electrode 20.

An equivalent circuit of the antenna apparatus 201 is illustrated in FIG. 2(C). In this manner, the frequency adjusting electrode 13 connected to the ground electrode is arranged close to and along the feeding electrode 11 and the non-feeding electrode 12. Thereby, respective capacitances are set between the frequency adjusting electrode 13 and the feeding electrode 11, and between the frequency adjusting electrode 13 and the non-feeding electrode 12.

As a result of this structure, respective capacitances are generated between the feeding electrode and the frequency adjusting electrode, and between the non-feeding electrode and the frequency adjusting electrode. A current flowing through the feeding electrode and the non-feeding electrode flows into the frequency adjusting electrode through the ground, and the frequency adjusting electrode becomes a current path. Hence, the resonant frequency of the antenna can be set by using the capacitances. Consequently, the resonant frequency of the antenna can be set without changing the area of a non-ground area to be formed on a circuit substrate on which the chip antenna is mounted. As a result, since the frequency can be lowered, a reduction in the sizes of a chip antenna and an antenna apparatus can be realized.

Figure 3:
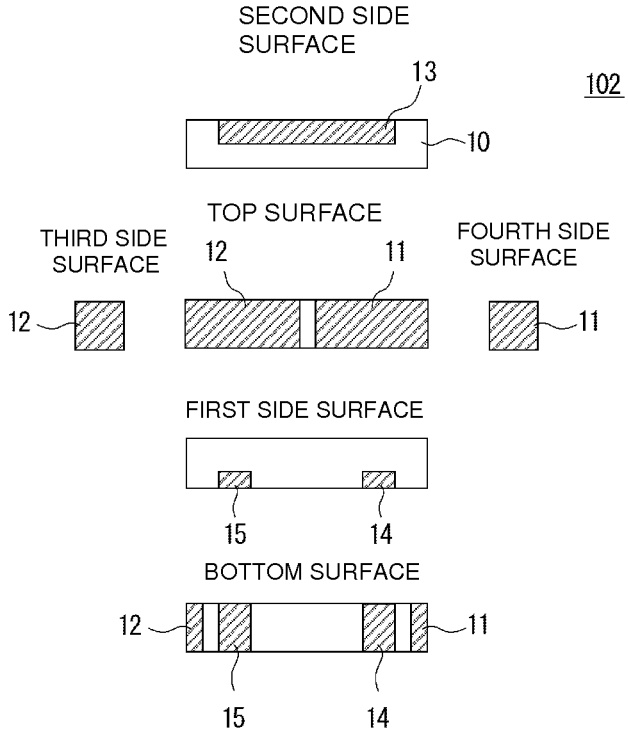
FIG. 3 is a six-surface diagram of a chip antenna 102 according to a second embodiment.

A second exemplary embodiment of the present disclosure is as follows:

FIG. 3 is a six-surface diagram of a chip antenna 102 according to a second embodiment.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the feeding electrode 11 and the non-feeding electrode 12 face each other with a predetermined distance therebetween on the top surface of the dielectric substrate 10.

The second side surface of the dielectric substrate 10 has a frequency adjusting electrode 13 formed thereon. Ground electrodes 14 and 15 that are electrically connected to the ground electrodes of a circuit substrate on which the chip antenna is mounted and that are electrically connected to the frequency adjusting electrode 13 are formed on the bottom surface of the dielectric substrate 10 and the first side surface.

In this manner, the frequency adjusting electrode 13 may extend from the bottom surface to the second side surface of the dielectric substrate 10.

Figure 4:
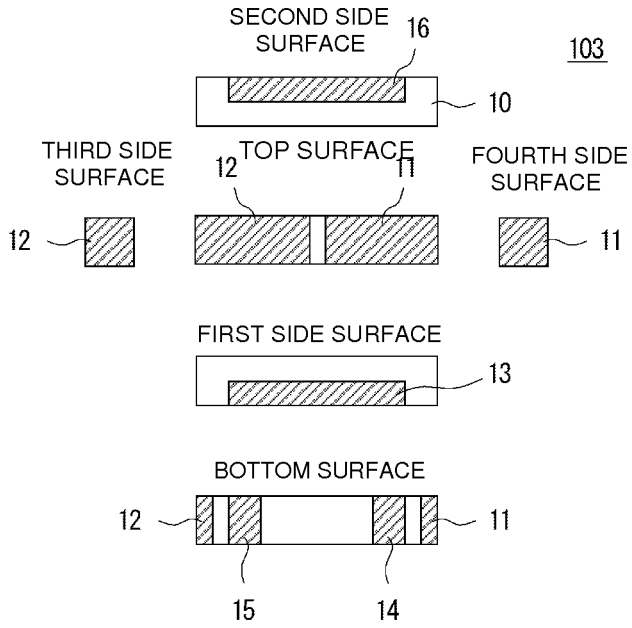
FIG. 4 is a six-surface diagram of a chip antenna 103 according to a third embodiment.

A third exemplary embodiment of the present disclosure is as follows:

FIG. 4 is a six-surface diagram of a chip antenna 103 according to a third embodiment.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the feeding electrode 11 and the non-feeding electrode 12 face each other with a predetermined distance therebetween on the top surface of the dielectric substrate 10.

The first side surface of the dielectric substrate 10 has a frequency adjusting electrode 13 formed thereon. In addition, the second side surface of the dielectric substrate has a frequency adjusting electrode 16 formed thereon. Ground electrodes 14 and 15 that are electrically connected to the ground electrodes of a circuit substrate on which the chip antenna is mounted and that are electrically connected to the frequency adjusting electrodes 13 and 16 are formed on the bottom surface of the dielectric substrate 10.

In this manner, the frequency adjusting electrodes 13 and 16 may be respectively formed on the first and second side surfaces of the dielectric substrate 10. As a result of this structure, larger respective capacitances are generated between the feeding electrode 11 and the frequency adjusting electrodes 13 and 16, and between the non-feeding electrode 12 and the frequency adjusting electrodes 13 and 16. As a result of the capacitances, a current flowing through the feeding electrode and the non-feeding electrode flows into the frequency adjusting electrodes through the ground, and the frequency adjusting electrodes become current paths. Consequently, the frequency can be lowered by a greater amount than the previous embodiments, and the resonant frequency of the antenna can be set. Hence, the resonant frequency of the antenna can be set without changing the area of a non-ground area to be formed on a circuit substrate on which the chip antenna is mounted.

Figure 5:
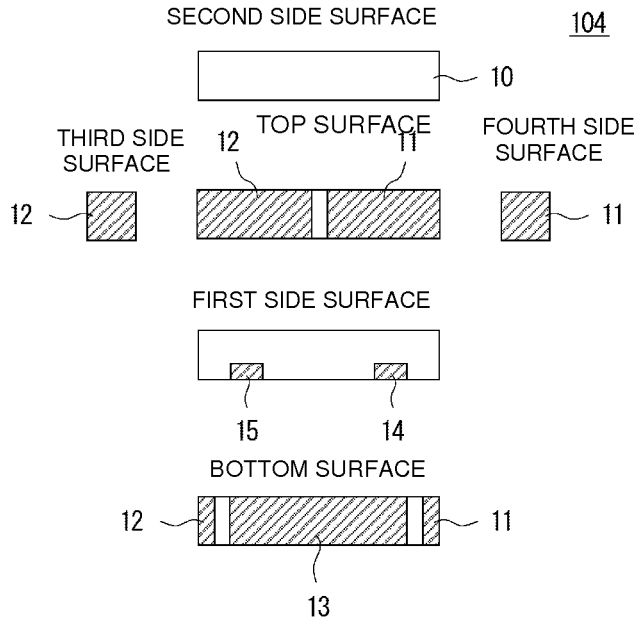
FIG. 5 is a six-surface diagram of a chip antenna 104 according to a fourth embodiment.

A fourth exemplary embodiment of the present disclosure is as follows:

FIG. 5 is a six-surface diagram of a chip antenna 104 according to a fourth embodiment.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the feeding electrode 11 and the non-feeding electrode 12 face each other with a predetermined distance therebetween on the top surface of the dielectric substrate 10.

A frequency adjusting electrode 13 is formed on the bottom surface of the dielectric substrate 10. In addition, ground electrodes 14 and 15 that are electrically connected to the ground electrodes of a circuit substrate on which the chip antenna is mounted and that are electrically connected to the frequency adjusting electrode 13 are formed on the first side surface of the dielectric substrate 10.

In this manner, as a result of forming the frequency adjusting electrode 13 on the bottom surface of the dielectric substrate 10, respective capacitances are generated between the frequency adjusting electrode 13 and the feeding electrode 11 with the dielectric substrate 10 therebetween, and between the frequency adjusting electrode 13 and the non-feeding electrode 12 with the dielectric substrate 10 therebetween. As a result, a current flowing through the feeding electrode and the non-feeding electrode flows into the frequency adjusting electrode through the ground. Thus, since the frequency adjusting electrode becomes a current path, the resonant frequency of the antenna can be set by using the capacitances. Hence, the resonant frequency of the antenna can be set without changing the area of a non-ground area to be formed on a circuit substrate on which the chip antenna is mounted.

Figure 6:
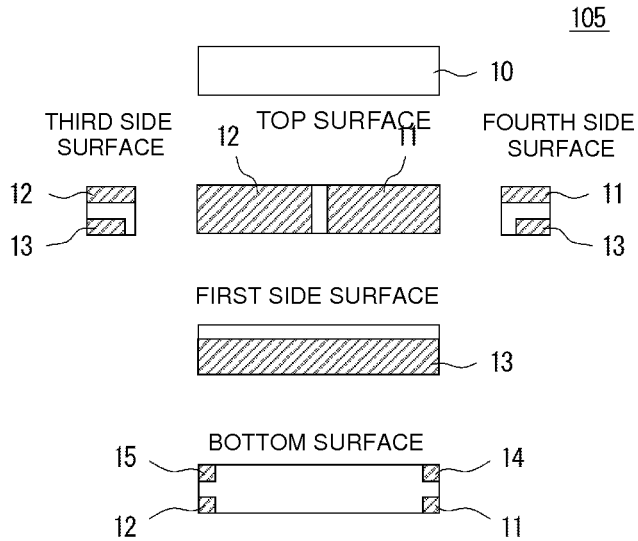
FIG. 6 is a six-surface diagram of a chip antenna 105 according to a fifth embodiment.

A fifth exemplary embodiment of the present disclosure is as follows:

FIG. 6 is a six-surface diagram of a chip antenna 105 according to a fifth embodiment.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the feeding electrode 11 and the non-feeding electrode 12 face each other with a predetermined distance therebetween on the top surface of the dielectric substrate 10.

Figure 2:
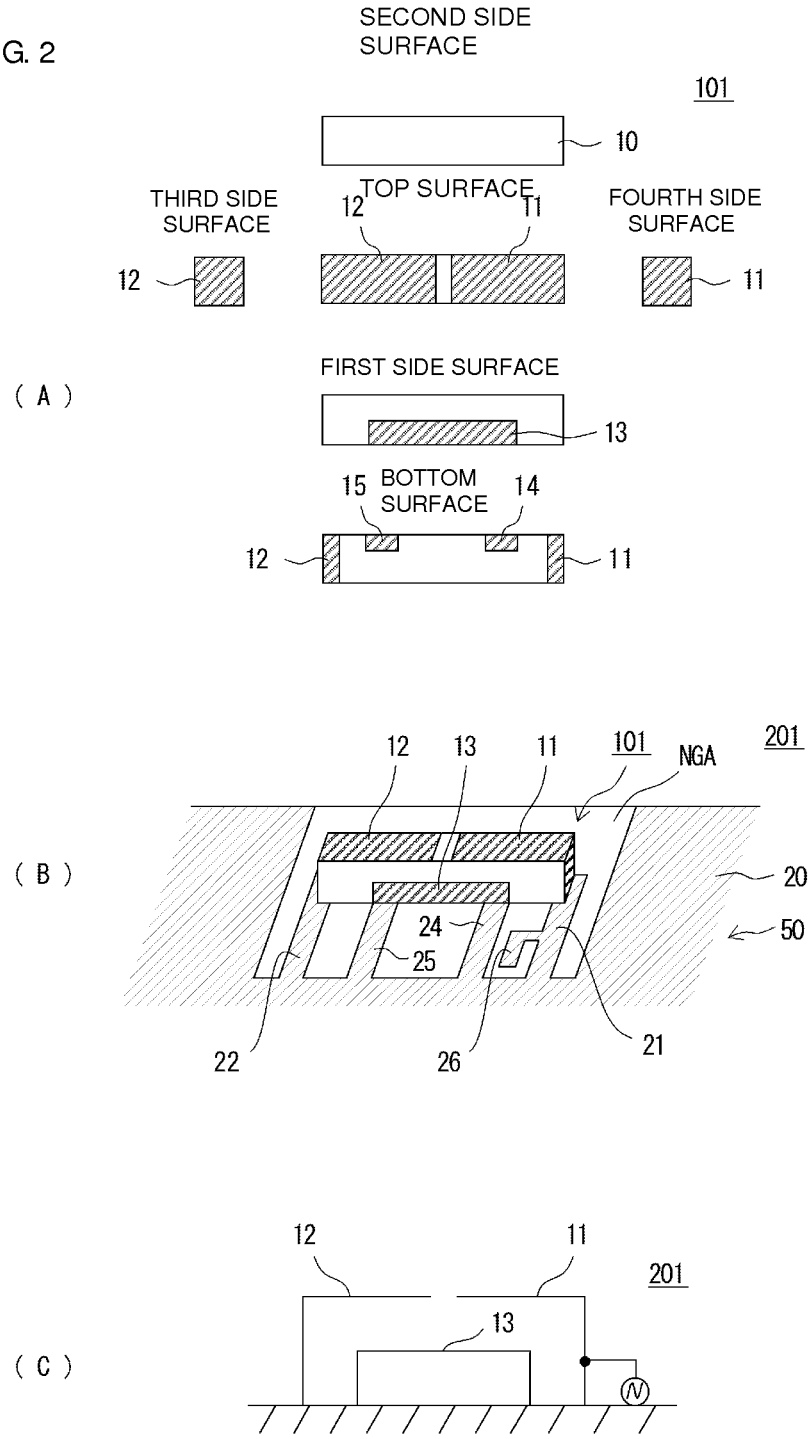
FIG. 2(A) is a six-surface diagram of a chip antenna 101 according to a first embodiment.
FIG. 2(B) is a perspective view of the main portions of an antenna apparatus 201 including the chip antenna 101.
FIG. 2(C) is an equivalent circuit of the antenna apparatus 201.

The difference from the example illustrated in FIG. 2 of the first embodiment is that part of the feeding electrode 11 is formed on the fourth side surface so as to have a width narrower than the width of the fourth side surface. Similarly, part of the non-feeding electrode 12 is formed on the third side surface so as to have a width narrower than the width of the third side surface.

A frequency adjusting electrode 13 is formed on the first side surface of the dielectric substrate 10. The frequency adjusting electrode 13 extends from the first side surface to the third and fourth side surfaces of the dielectric substrate 10.

Ground electrodes 14 and 15 that are electrically connected to the ground electrodes of a circuit substrate on which the chip antenna is mounted and that are electrically connected to the frequency adjusting electrode 13 are formed on the bottom surface of the dielectric substrate 10.

In this manner, by making the frequency adjusting electrode 13 extend from the first side surface to the third and fourth side surfaces of the dielectric substrate 10, the frequency adjusting electrode 13 and the feeding electrode 11 are made to be close to each other over a long distance, and the frequency adjusting electrode 13 and the non-feeding electrode 12 are made to be close to each other over a long distance, whereby predetermined relatively large capacitances can be respectively generated therebetween.

In addition, by making the widths of the feeding electrode 11 on the fourth side surface and the non-feeding electrode 12 on the third side surface narrow, inductance components at these narrow portions are increased, whereby the sizes of the antenna and electrodes for obtaining a predetermined frequency can be decreased, resulting in a corresponding reduction in size.

Figure 7:
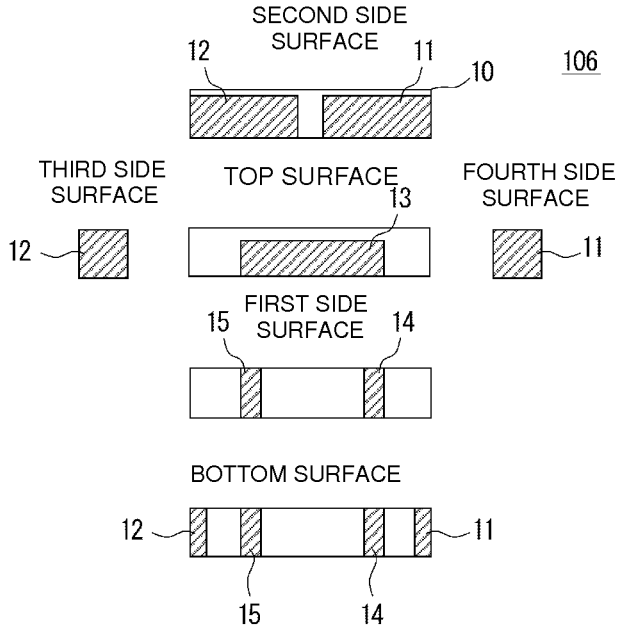
FIG. 7 is a six-surface diagram of a chip antenna 106 according to a sixth embodiment.

A sixth exemplary embodiment of the present disclosure is as follows:

FIG. 7 is a six-surface diagram of a chip antenna 106 according to a sixth embodiment.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface and fourth side surface of the dielectric substrate 10. In addition, the feeding electrode 11 is formed on the bottom surface and second side surface of the dielectric substrate 10. Similarly, a non-feeding electrode 12 is formed on the bottom surface and third side surface of the dielectric substrate 10. In addition the non-feeding electrode 12 is formed on the bottom surface and second side surface of the dielectric substrate 10. The leading ends (open ends) of the feeding electrode 11 and the non-feeding electrode 12 face each other with a predetermined distance therebetween on the second side surface of the dielectric substrate 10.

In this manner, also in the structure in which the feeding electrode 11 and the non-feeding electrode 12 are formed on the second side surface, respective capacitances are generated between the frequency adjusting electrode 13 and the feeding electrode 11, and between the frequency adjusting electrode 13 and the non-feeding electrode 12. As a result, a current flowing through the feeding electrode and the non-feeding electrode flows into the frequency adjusting electrode through the ground. Thus, since the frequency adjusting electrode becomes a current path, the resonant frequency of the antenna can be set by using the capacitances. Hence, the resonant frequency of the antenna can be set without changing the area of a non-ground area to be formed on a circuit substrate on which the chip antenna is mounted. As a result, the frequency can be decreased, whereby the sizes of the chip antenna and antenna apparatus can be reduced.

Figure 8:
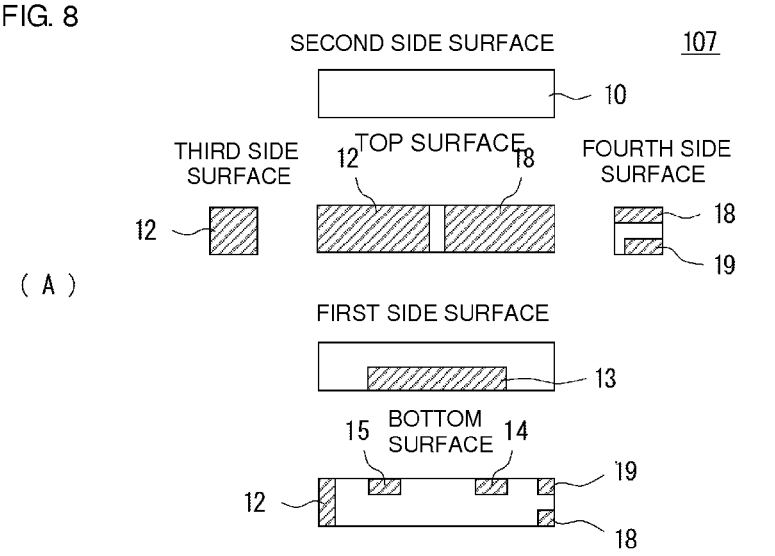
FIG. 8(A) is a six-surface diagram of a chip antenna 107 according to a seventh embodiment.
FIG. 8(B) is a perspective view of an antenna apparatus 207 using the chip antenna 107.
Figure 8:
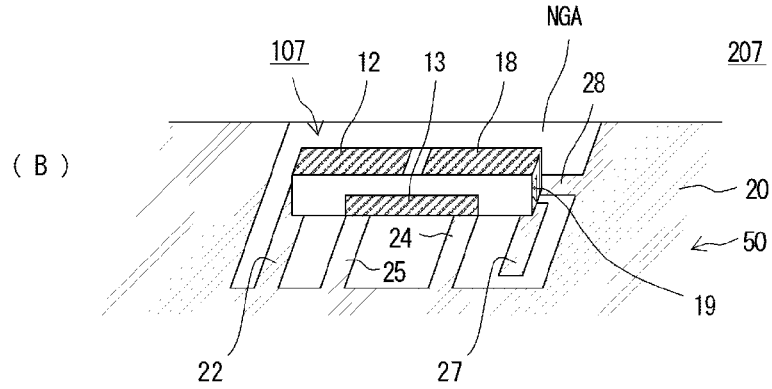

A seventh exemplary embodiment of the present disclosure is as follows:

FIG. 8(A) is a six-surface diagram of a chip antenna 107 according to a seventh embodiment and FIG. 8(B) is a perspective view of an antenna apparatus 207 using the chip antenna 107.

A dielectric substrate 10 shaped like a rectangular parallelepiped includes a bottom surface (mounting surface for a circuit substrate), a top surface, first and second side surfaces facing each other, and third and fourth side surfaces facing each other.

A non-feeding electrode 18 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the non-feeding electrode 18 and the non-feeding electrode 12 face each other with a predetermined distance therebetween on the top surface of the dielectric substrate 10.

The first side surface of the dielectric substrate 10 has a frequency adjusting electrode 13 formed thereon. Ground electrodes 14 and 15 that are electrically connected to the ground electrodes of a circuit substrate on which the chip antenna is mounted and that are electrically connected to the frequency adjusting electrode 13 are formed on the bottom surface of the dielectric substrate 10.

The difference from the example illustrated in FIG. 2 of the first embodiment is that a feeding electrode 19 and the non-feeding electrode 18 are formed on the fourth side surface so as to be close to each other.

Referring to FIG. 8(B), a ground electrode 20 is formed and a non-ground area NGA is provided on the top surface of a circuit substrate 50. The chip antenna 107 is mounted within the non-ground area NGA, as illustrated in the figure. The non-ground area NGA has non-feeding lines 22 and 28, ground lines 24 and 25, and a feeding line 27 provided therein. In a state in which the chip antenna 107 is mounted, a base portion of the feeding electrode 19 (portion of the feeding electrode 19 formed on the bottom surface of the dielectric substrate 10) is electrically connected to the feeding line 27. A base portion of the non-feeding electrode 12 (portion of the non-feeding electrode 12 formed on the bottom surface of the dielectric substrate 10) is electrically connected to the non-feeding line 22. Further, the ground electrodes 14 and 15 on the bottom surface are respectively electrically connected to the ground lines 24 and 25. A feeding circuit, which is not illustrated in FIG. 8(B), is connected between the feeding line 27 and the ground electrode 20.

As a result of this structure, a predetermined capacitance is generated between the non-feeding electrode 18 and the feeding electrode 19 on the fourth side surface of the dielectric substrate 10. Hence, by connecting the feeding circuit to the feeding line 27, the chip antenna 107 can be capacitively fed.

Figure 9:
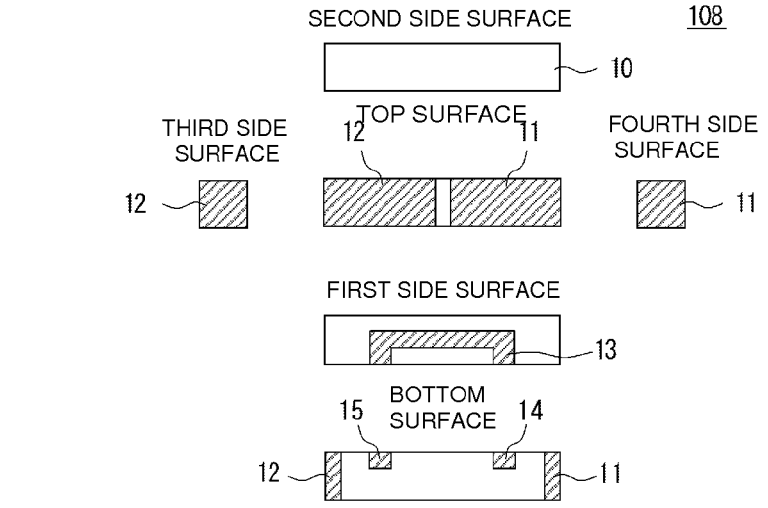
FIG. 9 is a six-surface diagram of a chip antenna 108 according to an eighth embodiment.

An eighth exemplary embodiment of the present disclosure is as follows:

FIG. 9 is a six-surface diagram of a chip antenna 108 according to an eighth embodiment.

A dielectric substrate 10 shaped like a rectangular parallelepiped includes a bottom surface (mounting surface for a circuit substrate), a top surface, first and second side surfaces facing each other, and third and fourth side surfaces facing each other.

A feeding electrode 11 is formed on the bottom surface, fourth side surface, and top surface of the dielectric substrate 10. A non-feeding electrode 12 is formed on the bottom surface, third side surface, and top surface of the dielectric substrate 10. The leading ends (open ends) of the feeding electrode 11 and the non-feeding electrode 12 face each other with a predetermined distance therebetween on the top surface of the dielectric substrate 10. The first side surface of the dielectric substrate 10 has a frequency adjusting electrode 13 formed thereon. Ground electrodes 14 and 15 that are electrically connected to the ground electrodes of a circuit substrate on which the chip antenna is mounted and that are electrically connected to the frequency adjusting electrode 13 are formed on the bottom surface of the dielectric substrate 10.

The difference from the example illustrated in FIG. 2 of the first embodiment is that the frequency adjusting electrode 13 formed on the first side surface in the shape of a half a loop.

Figure 10:
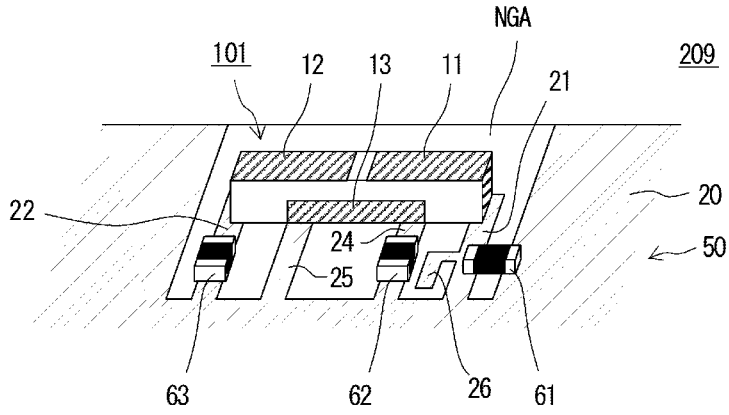
FIG. 10 is a perspective view of an antenna apparatus 209 according to a ninth embodiment.

A ninth exemplary embodiment of the present disclosure is as follows:

FIG. 10 is a perspective view of an antenna apparatus 209 according to a ninth embodiment.

A ground electrode 20 is formed and a non-ground area NGA is provided on the top surface of a circuit substrate 50. The chip antenna 101 is mounted within the non-ground area NGA, as illustrated in the figure. The chip antenna 101 is the same as the chip antenna 101 described in the first embodiment. The non-ground area NGA has a feeding line 21, a non-feeding line 22, ground lines 24 and 25, and a feeding branch line 26 provided therein.

In a state in which the chip antenna 101 is mounted, a base portion of the feeding electrode 11 (portion of the feeding electrode 11 formed on the bottom surface of the dielectric substrate 10) is electrically connected to the feeding line 21. A base portion of the non-feeding electrode (portion of the non-feeding electrode 12 formed on the bottom surface of the dielectric substrate 10) is electrically connected to the non-feeding line 22. Further, the ground electrodes 14 and 15 on the bottom surface are respectively electrically connected to the ground lines 24 and 25. A feeding circuit, which is not illustrated in FIG. 10, is connected between the feeding branch line 26 and the ground electrode 20.

In this example, a frequency adjusting device 63 is connected in series with the non-feeding line 22, a frequency adjusting device 62 is connected in series with the ground line 24, and an impedance device 61 is connected in parallel between the feeding line 21 and the ground electrode 20.

In this manner, the antenna apparatus 209 is formed by mounting the frequency adjusting devices 62 and 63, the impedance device 61, and the chip antenna 101 on the circuit substrate 50. The impedance device 61 and the frequency adjusting devices 62 and 63 are, for example, chip capacitors and/or chip inductors, and the impedances thereof allow the resonant frequency and the impedance of the antenna to be set. For example, the resonant frequency of the antenna can be lowered by making the frequency adjusting device 63 connected in series at the root portion of the non-feeding electrode 12 be an inductive device. In addition, the frequency can be adjusted using the frequency adjusting device 62 connected in series with the ground line 24 to which the frequency adjusting electrode 13 is connected. Further, impedance matching between the feeding circuit and the antenna apparatus 209 can be performed using the impedance device 61 connected between the feeding line 21 and the ground electrode 20.

While exemplary embodiments have been described above, it is to be understood that variations and modifications will be apparent to those skilled in the art without departing from the scope and spirit of the disclosure. The scope of the invention, therefore, is to be determined solely by the following claims and their equivalents.

What is claimed is:

1. A chip antenna comprising:

a rectangular parallelepiped shaped dielectric substrate including a bottom surface, a top surface, first and second side surfaces facing each other, and third and fourth side surfaces facing each other; and electrodes formed on outer surfaces of the dielectric substrate, the electrodes including:

a feeding electrode formed on the fourth side surface and the top surface, a non-feeding electrode formed on the third side surface and the top surface, the non-feeding electrode and the feeding electrode facing each other with a predetermined distance therebetween, a frequency adjusting electrode formed on the first side surface of the dielectric substrate, and a ground electrode connected to a ground electrode of a circuit substrate on which the chip antenna is mounted, the ground electrode being electrically connected to the frequency adjusting electrode and formed on the bottom surface of the dielectric substrate.

2. The chip antenna according to claim 1, wherein the ground electrode extends from the bottom surface to the second side surface of the dielectric substrate.

3. The chip antenna according to claim 2, wherein the frequency adjusting electrode extends to the third or fourth side surface or the third and fourth side surfaces of the dielectric substrate.

4. An antenna apparatus formed of the chip antenna according to claim 2 and the circuit substrate on which the chip antenna is mounted, wherein the circuit substrate is provided with a frequency adjusting device connected between the ground electrode of the circuit substrate and one, more than one, or all of the frequency adjusting electrode, the feeding electrode, the non-feeding electrode, and the ground electrode.

5. An antenna apparatus formed of the chip antenna according to claim 2 and the circuit substrate on which the chip antenna is mounted, wherein the circuit substrate is provided with an impedance device connected between a feeding line on the circuit substrate electrically connected to the feeding electrode and the ground electrode on the circuit substrate.

6. The chip antenna according to claim 1, wherein the frequency adjusting electrode is formed on the first and second side surfaces of the dielectric substrate.

7. The chip antenna according to claim 6, wherein the frequency adjusting electrode extends to the third or fourth side surface or the third and fourth side surfaces of the dielectric substrate.

8. An antenna apparatus formed of the chip antenna according to claim 6 and the circuit substrate on which the chip antenna is mounted, wherein the circuit substrate is provided with a frequency adjusting device connected between the ground electrode of the circuit substrate and one, more than one, or all of the frequency adjusting electrode, the feeding electrode, the non-feeding electrode, and the ground electrode.

9. An antenna apparatus formed of the chip antenna according to claim 6 and the circuit substrate on which the chip antenna is mounted, wherein the circuit substrate is provided with an impedance device connected between a feeding line on the circuit substrate electrically connected to the feeding electrode and the ground electrode on the circuit substrate.

10. The chip antenna according to claim 1, wherein the frequency adjusting electrode extends to the third or fourth side surface or the third and fourth side surfaces of the dielectric substrate.

11. An antenna apparatus formed of the chip antenna according to claim 10 and the circuit substrate on which the chip antenna is mounted, wherein the circuit substrate is provided with an impedance device connected between a feeding line on the circuit substrate electrically connected to the feeding electrode and the ground electrode on the circuit substrate.

12. An antenna apparatus formed of the chip antenna according to claim 1 and the circuit substrate on which the chip antenna is mounted, wherein the circuit substrate is provided with a frequency adjusting device connected between the ground electrode of the circuit substrate and one, more than one, or all of the frequency adjusting electrode, the feeding electrode, the non-feeding electrode, and the ground electrode.

13. A chip antenna comprising:

a rectangular parallelepiped shaped dielectric substrate including a bottom surface, a top surface, first and second side surfaces facing each other, and third and fourth side surfaces facing each other; and electrodes formed on outer surfaces of the dielectric substrate, the electrode including:

a feeding electrode formed on the fourth side surface and the top surface, and a non-feeding electrode formed on the third side surface and the top surface, the non-feeding electrode and the feeding electrode facing each other with a predetermined distance therebetween, a frequency adjusting electrode formed on the bottom surface of the dielectric substrate, and a ground electrode connected to a ground electrode of a circuit substrate on which the chip antenna is mounted, the ground electrode being electrically connected to the frequency adjusting electrode and formed on the first or second side surface or the first and second side surfaces of the dielectric substrate.

14. An antenna apparatus formed of the chip antenna according to claim 13 and the circuit substrate on which the chip antenna is mounted, wherein the circuit substrate is provided with a frequency adjusting device connected between the ground electrode of the circuit substrate and one, more than one, or all of the frequency adjusting electrode, the feeding electrode, the non-feeding electrode, and the ground electrode.

15. An antenna apparatus formed of the chip antenna according to claim 13 and the circuit substrate on which the chip antenna is mounted, wherein the circuit substrate is provided with an impedance device connected between a feeding line on the circuit substrate electrically connected to the feeding electrode and the ground electrode on the circuit substrate.

16. A chip antenna comprising:

a rectangular parallelepiped shaped dielectric substrate including a bottom surface, a top surface, first and second side surfaces facing each other, and third and fourth side surfaces facing each other; and electrodes formed on outer surfaces of the dielectric substrate, the electrodes including:

a first non-feeding electrode is formed on the fourth side surface and the top surface, and a second non-feeding electrode is formed on the third side surface and the top surface, the first and second non-feeding electrodes facing each other with a predetermined distance therebetween, a frequency adjusting electrode formed on the first side surface of the dielectric substrate, a ground electrode formed on the bottom surface of the dielectric substrate and connected to a ground electrode of a circuit substrate on which the chip antenna is mounted and electrically connected to the frequency adjusting electrode, wherein the dielectric substrate is provided with a feeding electrode such that a capacitance is generated between the feeding electrode and the first or second non-feeding electrode, the feeding electrode being electrically connected to a feeding line on a circuit substrate on which the chip antenna is mounted.

17. An antenna apparatus formed of the chip antenna according to claim 16 and the circuit substrate on which the chip antenna is mounted, wherein the circuit substrate is provided with a frequency adjusting device connected between the ground electrode of the circuit substrate and one, more than one, or all of the frequency adjusting electrode, the feeding electrode, the non-feeding electrode, and the ground electrode.

18. An antenna apparatus formed of the chip antenna according to claim 16 and the circuit substrate on which the chip antenna is mounted, wherein the circuit substrate is provided with an impedance device connected between a feeding line on the circuit substrate electrically connected to the feeding electrode and the ground electrode on the circuit substrate.

* * * * *